US008182275B2

(12) United States Patent
Suzuki et al.

(10) Patent No.: US 8,182,275 B2
(45) **Date of Patent: *May 22, 2012**

(54) LEVER CONNECTOR WITH A CONNECTING MEMBER MANIPULATING MECHANISM FOR TURNING A TURN LEVER TO MANIPULATE A CONNECTING MEMBER

(75) Inventors: Sachio Suzuki, Hitachi (JP); Hideaki Takehara, Hitachi (JP); Kunihiro Fukuda, Tsukuba (JP); Yuta Kataoka, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/023,790

(22) Filed: Feb. 9, 2011

(65) Prior Publication Data

US 2011/0250771 A1 Oct. 13, 2011

(30) Foreign Application Priority Data

Apr. 13, 2010 (JP) ..... 2010-092515

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 4,740,164 A 4/1988 Schulz et al.
5,709,560 A 1/1998 Hio
5,797,758 A 8/1998 Tsuchiya et al.
5,938,458 A 8/1999 Krehbiel et al.
6,217,354 B1 4/2001 Fenci et al.
6,305,957 B1 10/2001 Fink et al.
6,319,050 B1 11/2001 Miyazaki et al.
6,371,778 B1 4/2002 Watanabe
6,551,118 B2 4/2003 Langolf et al.
6,881,081 B2 4/2005 Gundermann et al.
7,165,984 B1 1/2007 Behrens et al.

(Continued)

FOREIGN PATENT DOCUMENTS

JP 9-120862 A 5/1997

(Continued)

OTHER PUBLICATIONS

U.S. Appl. No. 13/023,784, filed Feb. 9, 2011, Suzuki et al.

(Continued)

*Primary Examiner* — Tho D Ta
(74) *Attorney, Agent, or Firm* — Foley & Lardner LLP

(57) ABSTRACT

A lever connector includes a first connector portion including a first terminal housing with a plurality of first connecting terminals, a second connector portion including a second terminal housing with a plurality of second connecting terminals, a plurality of isolating plates, a connecting member to fix the first and second connecting terminals at the contacts therebetween, and a lever structure including a turn lever provided to hold both sides of either one of the first or second terminal housing. The lever structure includes a connecting member manipulating mechanism for turning the turn lever to manipulate the connecting member to apply a pressing force to each of the contacts or release the applying of that pressing force. The connecting member manipulating mechanism includes a contact holding means for maintaining the electrical connections between the first and second connecting terminals, respectively, even in the event of the absence of the turn lever.

8 Claims, 10 Drawing Sheets

1 LEVER CONNECTOR
2 FIRST CONNECTOR PORTION
3 SECOND CONNECTOR PORTION
5 FIRST TERMINAL HOUSING
7 SECOND TERMINAL HOUSING
9 CONNECTING MEMBER
50 LEVER STRUCTURE
52 HOUSING ATTACHING/DETACHING MECHANISM
53 CONNECTING MEMBER MANIPULATING MECHANISM
71 PRESSING MEMBER GUIDING PORTION

U.S. PATENT DOCUMENTS

| | | | | |
|---|---|---|---|---|
| 7,214,078 | B2 | 5/2007 | Fukatsu | |
| 7,335,038 | B2 | 2/2008 | Duval | |
| 7,677,908 | B2 | 3/2010 | Sugiyama et al. | |
| 7,794,247 | B2 | 9/2010 | Suzuki | |
| 7,794,248 | B2 | 9/2010 | Kobayashi | |
| 7,959,451 | B2 | 6/2011 | Tonosaki | |
| 2011/0189883 | A1* | 8/2011 | Suzuki et al. | 439/372 |
| 2011/0250770 | A1* | 10/2011 | Suzuki et al. | 439/157 |

FOREIGN PATENT DOCUMENTS

| | | | |
|---|---|---|---|
| JP | 3070460 | B2 | 5/2000 |
| JP | 2003-17190 | | 1/2003 |
| JP | 2004-56924 | A | 2/2004 |
| JP | 4037199 | B2 | 11/2007 |
| JP | 4075333 | B2 | 2/2008 |
| JP | 2009-70754 | A | 4/2009 |

OTHER PUBLICATIONS

S. Suzuki, U.S. PTO Notice of Allowance, U.S. Appl. No. 13/023,784, dated Sep. 29, 2011, 11 pages.

* cited by examiner

1 LEVER CONNECTOR
2 FIRST CONNECTOR PORTION
3 SECOND CONNECTOR PORTION
5 FIRST TERMINAL HOUSING
7 SECOND TERMINAL HOUSING
9 CONNECTING MEMBER
50 LEVER STRUCTURE
52 HOUSING ATTACHING/DETACHING MECHANISM
53 CONNECTING MEMBER MANIPULATING MECHANISM
71 PRESSING MEMBER GUIDING PORTION

5 FIRST TERMINAL HOUSING
7 SECOND TERMINAL HOUSING
9 CONNECTING MEMBER
50 LEVER STRUCTURE
52 HOUSING ATTACHING/DETACHING MECHANISM
53 CONNECTING MEMBER MANIPULATING MECHANISM
71 PRESSING MEMBER GUIDING PORTION

2 FIRST CONNECTOR PORTION
4a, 4b, 4c FIRST CONNECTING TERMINAL
5 FIRST TERMINAL HOUSING
8a, 8b, 8c 8d ISOLATING PLATE
9 CONNECTING MEMBER

3 SECOND CONNECTOR PORTION
6a, 6b, 6c SECOND CONNECTING TERMINAL

LEVER CONNECTOR WITH A CONNECTING MEMBER MANIPULATING MECHANISM FOR TURNING A TURN LEVER TO MANIPULATE A CONNECTING MEMBER

The present application is based on Japanese patent application No. 2010-092515 filed on Apr. 13, 2010, the entire contents of which are incorporated herein by reference.

BACKGROUND OF THE INVENTION

1. Field of the Invention

The present invention relates to a lever connector, for use in eco-friendly cars, such as hybrid vehicles, electric vehicles and the like, and in particular, for being capable of use for a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal (refer to JP-A-2009-070754, for example).

To facilitate attaching and detaching (mating and unmating) of the two connector portions (i.e., the male connector portion and the female connector portion) to and from each other, this connector is often provided with a lever structure (refer to JP patent No. 3070460 and JP patent No. 4075333, for example).

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP patent No. 4037199, is known in the art.

JP patent No. 4037199 discloses an electrical connection structure, which is for connecting multiphase conductive member connecting terminals drawn out from a motor for driving the vehicle, and multiphase power line cable connecting terminals drawn out from an inverter for driving the motor. The technique used in the electrical connection structure disclosed by JP patent No. 4037199 is as follows: Each phase connecting terminal of the conductive member and each corresponding phase connecting terminal of the power line cable are overlapped, and isolating plates are disposed on opposite surfaces to the overlapped surfaces of the connecting terminals, respectively, and these overlapped connecting terminals and isolating plates are collectively fastened in an overlapping direction with a single bolt provided in a position to penetrate these overlapped connecting terminals and isolating plates.

That is, in the technique used in the electrical connection structure (herein referred to as "the stacked connection structure") disclosed by JP patent No. 4037199, the single bolt is tightened in the overlapping direction (stacking direction), to collectively hold the multiplicity of contacts between the connecting terminals, which are the overlapped surfaces of the connecting terminals, and thereby fix the connecting terminals at the contacts therebetween, for electrical connections between the connecting terminals, respectively. This configuration disclosed by JP patent No. 4037199 is effective in easily ensuring size reduction, compared to the technique disclosed by JP-A-2009-070754, for example.

Refer to JP-A-2009-070754, JP patent Nos. 3070460, 4075333, and 4037199, for example.

SUMMARY OF THE INVENTION

The inventors have contemplated a lever connector that uses the technique disclosed by JP patent No. 4037199 and allows turning of a turn lever of a lever structure to interlock with "a connecting member manipulating mechanism for manipulating a connecting member such as a bolt (in JP patent No. 4037199, a bolt indicated by numeral 18) to apply a specified pressing force to the contacts to fix the contacts" which is necessary for the stacked connection structure.

For example, the inventors have contemplated the lever connector that the turn lever is substantially U-shaped to hold both sides of a terminal housing to realize the interlocking of the manipulation of the connecting member of the connecting member manipulating mechanism and the turning of the turn lever, and that the connecting member is fixed to a turn shaft of the turn lever such that the connecting member turns integrally with that turn lever, and that the connecting member is formed with a male screw to be screwed into a female screw formed in the terminal housing such that the connecting member is threaded into the terminal housing to apply pressing force to each contact by turning the turn lever and screwing the male screw and the female screw together.

The lever connector allows the connecting member to hold the pressing force applied to each contact by turning and then locking the turn lever.

In general, the lever connector is constructed such that the turn lever is disposed outside of the terminal housings (i.e., the first terminal housing and the second terminal housing). Therefore, the turn lever may be broken when another member strikes against the lever connector. Thus, the lever connector needs to secure electrical conduction through the contacts even when the turn lever is broken. Especially in case of the lever connector applied to a hybrid vehicle or electric vehicle, an interruption of electrical conduction through the contacts may render the vehicle impossible to move, and it is therefore crucial to be able to secure the electrical conduction through the contacts even when the turn lever is broken.

However, in the above lever connector, when the turn lever is broken, the connecting member is held in the terminal housing, only by the male screw formed in the connecting member being screwed into the female screw of the terminal housing. Therefore, the problem arises that the screwing may be loosened due to vibration specific to vehicles, etc., causing the connecting member to slip out of the terminal housing at worst to insufficiently have the electrical conduction through the contacts.

In view of the above, it is an object of the present invention to provide a lever connector, which has a stacked connection structure into which one connecting member is tightened in an overlapping direction to collectively hold a plurality of contacts between connecting terminals, which are the overlapped surfaces of the connecting terminals, and thereby fix the connecting terminals at the contacts therebetween for electrical connections between the connecting terminals respectively, allowing assurance of electrical conduction through the contacts, even if a turn lever is broken.

(1) According to one embodiment of the invention, a lever connector comprises:

a first connector portion including a first terminal housing with a plurality of first connecting terminals aligned and accommodated therein;

a second connector portion including a second terminal housing with a plurality of second connecting terminals aligned and accommodated therein;

a plurality of isolating plates aligned and accommodated in the first terminal housing;

a stacked connection structure that, when the first terminal housing and the second terminal housing are mated together, the plural first connecting terminals and the plural second connecting terminals face each other to form pairs, respectively, and the isolating plates, the first connecting terminals and the second connecting terminals are disposed alternately;

a connecting member provided to the first connector portion, and including a head to press the adjacent isolating plate, to thereby fix the first connecting terminals and the second connecting terminals at the contacts therebetween, for electrical connections between the first connecting terminals and the second connecting terminals, respectively; and a lever structure including a turn lever provided to hold both sides of either one of the first terminal housing or the second terminal housing, and turnably pivoted to the first terminal housing or the second terminal housing, wherein the lever structure comprises a connecting member manipulating mechanism for turning the turn lever to thereby manipulate the connecting member, to apply a pressing force to each of the contacts, or release the applying of that pressing force, and wherein the connecting member manipulating mechanism includes a contact holding means for, when the pressing force is being applied to each of the contacts, maintaining the pressing force applied to each of the contacts, to maintain the electrical connections between the first connecting terminals and the second connecting terminals, respectively, even in the event of the absence of the turn lever.

In the above embodiment (1) of the invention, the following modifications and changes can be made.

(i) The connecting member manipulating mechanism includes a first locking portion comprising protrusions formed at the head of the connecting member; and a pressing member including a base provided to turn integrally with the turn lever, and a second locking portion comprising a protrusion formed at the base, the pressing member for, when the turn lever is turned, allowing the second locking portion to move onto the first locking portion to press the head of the connecting member, to thereby apply the pressing force to each of the contacts, and the contact holding means comprises a pressing member guiding portion provided in the first terminal housing, for, when both the terminal housings are mated together, guiding and receiving the pressing member, and for, when the turn lever is turned to cause the pressing member to press the head of the connecting member, regulating and holding the pressing member so that the pressing member is not moved in the opposite direction to its pressing direction.

(ii) The first connector portion is attached to a device and the second connector portion is attached to a cable to electrically connect the device and the cable, and the turn lever is attached to the second terminal housing.

(iii) The lever structure further includes a housing attaching/detaching mechanism for turning the turn lever to thereby pull and mate the first terminal housing and the second terminal housing together, or pull the first terminal housing and the second terminal housing apart to release the mating thereof, when the first connector portion and the second connector portion are connected together, the turn lever is first turned, to allow the housing attaching/detaching mechanism to pull and mate the first terminal housing and the second terminal housing together, and the turn lever is thereafter turned further, to allow the connecting member manipulating mechanism to manipulate the connecting member, to apply the pressing force to each of the contacts.

(iv) The lever structure is configured so that the turn lever is turned in one turning direction from a releasing position into a mating position, to thereby allow the housing attaching/detaching mechanism to pull and mate both the terminal housings together, and so that the turn lever is turned further in one turning direction from the mating position into a fixing position, to thereby allow the connecting member manipulating mechanism to manipulate the connecting member, to apply the pressing force to each of the contacts, the housing attaching/detaching mechanism includes slide shafts comprising protrusions formed to protrude from both sides respectively of the first terminal housing, slide grooves formed in a mating direction in both sides respectively of the second terminal housing, to guide the slide shafts, and a first cam groove formed in the turn lever, and for, when the first cam groove receives the slide shafts inserted into the slide grooves at the releasing position, and the turn lever is then turned into the mating position, fixing the slide shafts between it and the slide grooves, pulling the first terminal housing into the second terminal housing, and mating both the terminal housings, and the connecting member manipulating mechanism further includes a second cam groove formed in the turn lever to be continuous with the first cam groove, and for turning the turn lever from the mating position to the fixing position with both the terminal housings being maintained to be mated together.

(v) The first locking portion and/or the second locking portion is formed with a sloping portion in a turning direction for, when the turn lever is turned, allowing the second locking portion to easily move onto the first locking portion, and the head of the connecting member is formed with a rotation regulating portion to regulate the rotation of the connecting member so that the connecting member is not rotated with the turning of the pressing member.

(vi) Both the connector portions are connected by turning the turn lever in the direction of separating from the first terminal housing.

(vii) The lever connector further comprises an elastic member provided between the head of the connecting member and the adjacent isolating plate, to apply a specified pressing force to the adjacent isolating plate.

Points of the Invention

According to one embodiment of the invention, a lever connector is provided with a connecting member manipulating mechanism that includes a contact holding means for maintaining the pressing force applied to each contact, to maintain the electrical connections between the first connecting terminals and the second connecting terminals even when the turn lever is broken. This allows the electrical conduction through the contacts to be secured even when the turn lever is broken. Thus, by applying the lever connector to a hybrid vehicle or electric vehicle, even when the turn lever is broken, the interruption of the electrical conduction through the contacts can be prevented that renders the vehicle impossible to move.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment according to the invention, referring to the accompanying drawings.

Figure 1A:
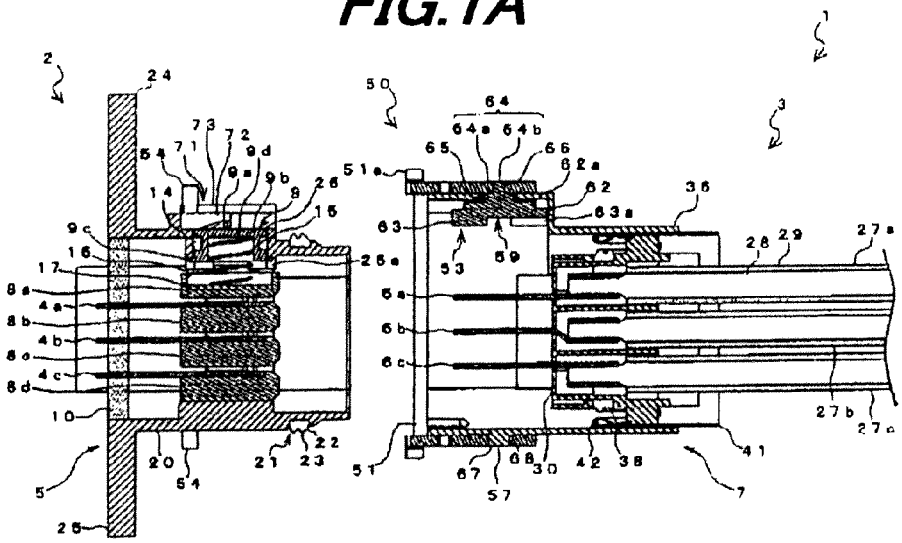
FIGS. 1A and 1B are a cross-sectional view and a perspective view, respectively, showing a lever connector before mating two connector portions, in one embodiment according to the invention.
Figure 1B:
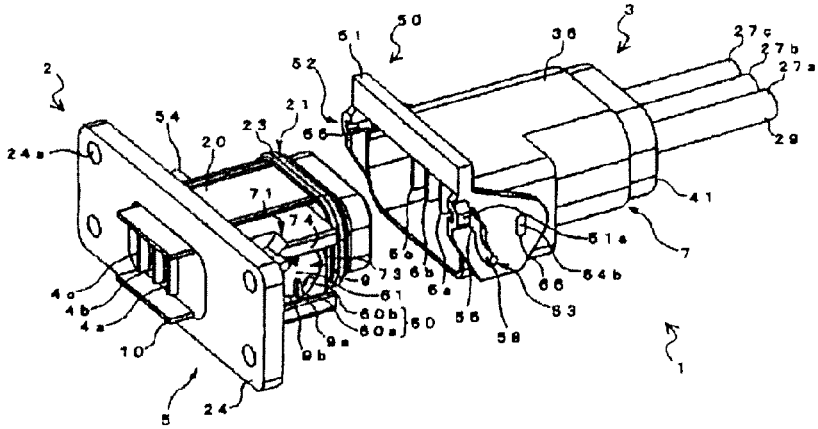
Figure 2A:
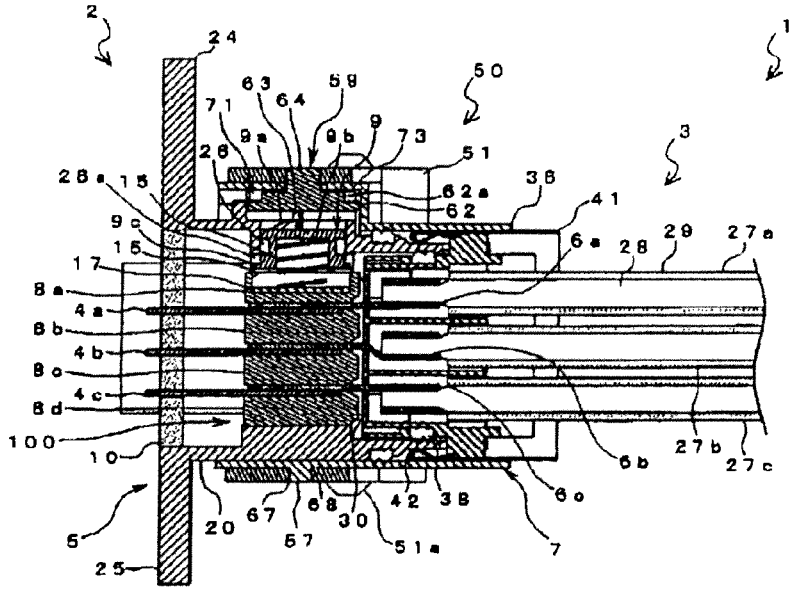
FIGS. 2A and 2B are a cross-sectional view and a perspective view, respectively, showing the lever connector of FIGS. 1A and 1B when mating the two connector portions, and setting a turn lever into a fixing position.
Figure 2B:
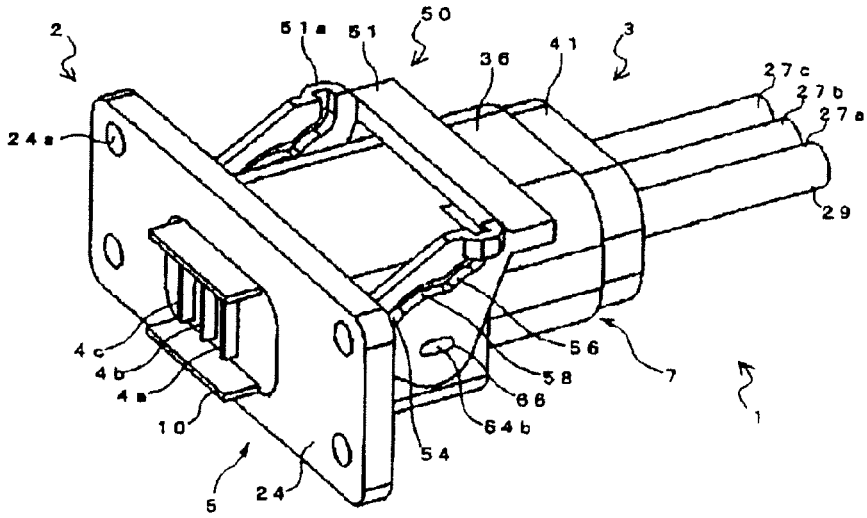

FIGS. 1A and 1B are a cross-sectional view and a perspective view, respectively, showing a lever connector before mating two connector portions, in one embodiment according to the invention, and FIGS. 2A and 2B are a cross-sectional view and a perspective view, respectively, showing the lever connector of FIGS. 1A and 1B when mating the two connector portions, and setting a turn lever into a fixing position.

Lever Connector 1 Structure

As shown in FIGS. 1A to 2B, the lever connector 1 in this embodiment is constructed of a first connector portion 2 and a second connector portion 3, which are mated with each other, to thereby collectively connect a plurality of power lines.

More specifically, the lever connector 1 includes the first connector portion 2 having a first terminal housing (male terminal housing) 5 with a plurality of (three) first connecting terminals (male terminals) 4*a* to 4*c* aligned and accommodated therein, the second connector portion 3 having a second terminal housing (female terminal housing) 7 with a plurality of (three) second connecting terminals (female terminals) 6*a* to 6*c* aligned and accommodated therein, and a plurality of (four) isolating plates 8*a* to 8*d* aligned and accommodated in the first terminal housing 5. When the first terminal housing 5 of the first connector portion 2 and the second terminal housing 7 of the second connector portion 3 are mated with each other, the plural first connecting terminals 4*a* to 4*c* and the plural second connecting terminals 6*a* to 6*c* face each other to form pairs, respectively (i.e. each pair of the first connecting terminal 4*a* and the second connecting terminal 6*a*, the first connecting terminal 4*b* and the second connecting terminal 6*b*, and the first connecting terminal 4*c* and the second connecting terminal 6*c*), and result in the lever connector 1 having a stacked connection structure 100 of the pairs of the first connecting terminals 4*a* to 4*c* and the second connecting terminals 6*a* to 6*c* alternately interleaved with the plural isolating plates 8*a* to 8*d*.

This lever connector 1 is used for connection of a vehicle drive motor and an inverter for diving that motor, for example. In this embodiment, the first connector portion 2 and the second connector portion 3 are configured so that the first connector portion 2 is provided on a device side such as the motor or inverter side, while the second connector portion 3 is provided on a cable side, and the first connector portion 2 and the second connector portion 3 are connected together to thereby electrically connect the device and the cable.

More specifically, for example when the first connector portion 2 is provided to the motor, the first terminal housing 5 of the first connector portion 2 (in FIG. 1A, left side portion) is mated with a shield case of the motor, and the first connecting terminal 4*a* to 4*c* portions exposed from the first terminal housing 5 are connected to terminals, respectively, of a terminal block installed in the shield case of the motor. Mating to this first connector portion 2 the second connector portion 3 electrically connected with the inverter results in electrical connection of the motor and the inverter. Although the foregoing is concerned with the motor side connection, the same applies to the inverter side connection. Although the length of the first connecting terminal 4*a* to 4*c* portions exposed from the first terminal housing 5 is depicted as being not very long in the drawings, that length may appropriately be altered so as to fit to the terminal block installed in the shield case to which the first connecting terminal 4*a* to 4*c* portions are connected. Also, the shape of the first connecting terminal 4*a* to 4*c* portions exposed from the first terminal housing 5 may appropriately be modified so as to fit to the terminal block installed in the shield case to which the first connecting terminal 4*a* to 4*c* portions are connected.

First and Second Connector Portions 2 and 3

Below are described the respective specific structures of the first connector portion 2 and the second connector portion 3.

First Connector Portion 2

First is described the first connector portion 2.

Referring to FIGS. 1A to 3B, the first connector portion 2 has the three first connecting terminals 4*a* to 4*c* held therein to be aligned at a specified pitch, and includes the first terminal housing 5 for accommodating the three aligned first connecting terminals 4*a* to 4*c*, the plural substantially rectangular parallelepiped isolating plates 8*a* to 8*d* provided in the first terminal housing 5 for isolating each of the first connecting terminals 4*a* to 4*c*, and a connecting member 9 with a head 9*b* to be pressed against the adjacent isolating plate 8*a*, to thereby collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively.

First Connecting Terminals 4*a* to 4*c*

Figure 5:
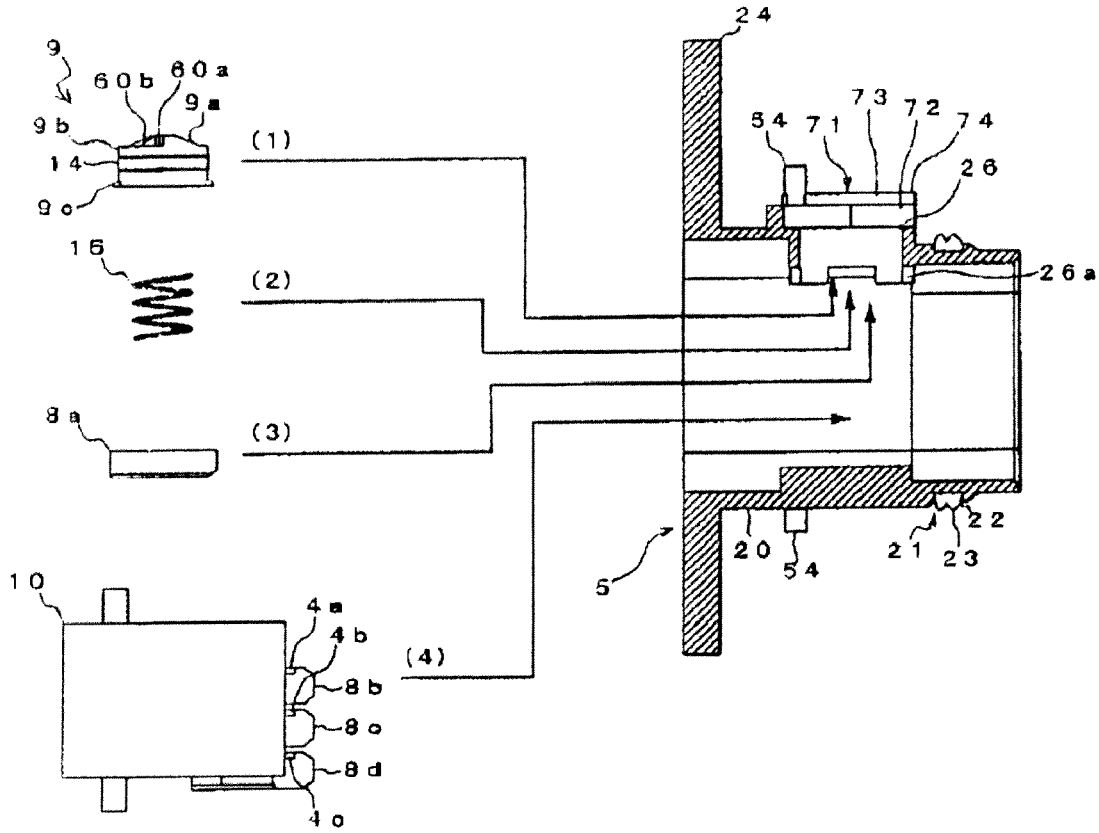
FIG. 5 is a diagram for explaining a procedure for assembling the first connector portion of FIGS. 3A and 3B.

The first connecting terminals 4*a* to 4*c* are plate terminals, and are held to be aligned at a specified pitch by being spaced apart from each other by a molded resin material 10, which forms a portion of the first terminal housing 5. The molded resin material 10 is formed by a body for aligning and holding the first connecting terminals 4*a* to 4*c*, and a pair of walls formed in a plate shape to hold both sides of that body therebetween. The walls of the molded resin material 10 are formed to cover most of the side surfaces of the first connecting terminals 4*a* to 4*c*, as shown in FIG. 5. Also, the molded resin material 10 material is an insulating resin (e.g. PPS (polyphenylene sulfide) resin, PPA (polyphthalamide) resin, PA (polyamide) resin, PBT (polybutylene terephthalate), epoxy based resin). As a method for holding the first connecting terminals 4*a* to 4*c* with the molded resin material 10, there is a holding method by inserting the first connecting terminals 4*a* to 4*c* during molding of the molded resin material 10 and then curing the resin, or a holding method by pressing the first connecting terminals 4*a* to 4*c* into the molded resin material 10 which has been molded beforehand.

The first connecting terminals 4*a* to 4*c* are supplied with electricity at different voltages and/or currents, respectively. For example, in this embodiment, power lines are assumed to be for three phase alternating current between a motor and an inverter, so that the first connecting terminals 4*a* to 4*c* are supplied with alternating currents, respectively, which are 120 degrees out of phase with each other. For the purpose of reducing the loss of power transmitted through the lever connector 1, the first connecting terminals 4*a* to 4*c* may each be formed of a metal such as a high conductivity silver, copper, aluminum, or the like. Also, the first connecting terminals 4*a* to 4*c* each have slight flexibility.

Isolating Plates 8*a* to 8*d*

The plural isolating plates 8*a* to 8*d* comprise the plurality of second isolating plates 8*b* to 8*d* aligned and accommodated in the first terminal housing 5, and integrally fixed to one side of the plural first connecting terminals 4*a* to 4*c*, respectively, (i.e. to the opposite side to the side joined with the second connecting terminals 6*a* to 6*c*), and the first isolating plate 8*a* provided to be integrally fixed to an inner surface of the first terminal housing 5, and to face one side of the second connecting terminal 6*a* (i.e. the opposite side to the side joined with the first connecting terminal 4*a*) positioned at the outermost side (in FIG. 1A, most upper side) when stacking the plural first connecting terminals 4*a* to 4*c* and the plural second connecting terminals 6*a* to 6*c*.

The plural isolating plates 8*a* to 8*d* are fixed to such a position as to protrude from the tips of the first connecting terminals 4*a* to 4*c*. Each of these isolating plates 8*a* to 8*d* is chamfered at each of its corners on the second connecting terminal 6*a* to 6*c* inserting/removing side.

Figure 4A:
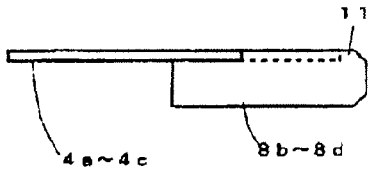
FIGS. 4A and 4B are a side view and a top view, respectively, showing first connecting terminals of the first connector portion of FIGS. 3A and 3B.
Figure 4B:
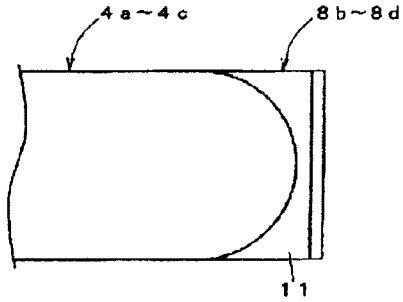

Also, referring to FIGS. 4A and 4B, each of the plural second isolating plates 8*b* to 8*d* is formed with a protruding portion (thickened surface) 11 of its surface fixed to the first connecting terminals 4*a* to 4*c* to fill the level difference therebetween, so that the upper surfaces (in the figure, the upper sides) of the plural second isolating plates 8*b* to 8*d* are coplanar with the upper surfaces (in the figure, the upper sides) of the first connecting terminals 4*a* to 4*c*, respectively. With this configuration, when the first connector portion 2 and the second connector portion 3 are mated with each other, the tips of the first connecting terminals 4*a* to 4*c* do not contact the inserted tips of the second connecting terminal 6*a* to 6*c*. The insertability of the second connecting terminal 6*a* to 6*c* is therefore enhanced.

Connecting Member 9

Referring again to FIGS. 1A to 3B, the connecting member 9 has its columnar head 9*b*, which serves as a pressing portion to be pressed against the adjacent first isolating plate 8*a*, and a first locking portion 9*a* formed integrally with that head 9*b*, and comprising a protrusion formed to protrude upwardly from the opposite surface (herein, simply referred to as the upper surface) of that head 9*b* to the first isolating plate 8*a*. The first locking portion 9*a* is described later.

The connecting member 9 made of a metal, such as SUS, iron, copper alloy or the like, may be used. The connecting member 9 made of a resin may be used, but it is preferable that the metallic connecting member 9 be used from the point of view of strength.

The head 9*b* is formed with a protrusion 9*c*, which serves as a rotation regulating portion to regulate the rotation of the connecting member 9 so that the connecting member 9 is not rotated with the turning of a later-described pressing member 59. The protrusion 9*c* is formed at a lower portion (in FIG. 1A, the lower portion) of the head 9*b*, and comprises two protrusions (see FIG. 10D), which protrude diametrically outwardly from opposing positions, respectively, in the side surface of the head 9*b*. This protrusion 9*c* is engaged into an engaging groove 26*a* formed in the first terminal housing 5 at a rim of a later-described connecting member insertion hole 26, to regulate the rotation of the connecting member 9, and prevent the connecting member 9 from slipping out of the first terminal housing 5. The head 9*b* of the connecting member 9 is provided with a packing 14 therearound for preventing water from penetrating into the first terminal housing 5.

Also, between the lower surface of the head 9*b* of the connecting member 9 and the upper surface of the first isolating plate 8*a* directly therebelow is provided an elastic member 15 for applying a specified pressing force to the first isolating plate 8*a*. In this embodiment, a recessed portion 9*d* is formed in the lower surface of the head 9*b*, so that an upper portion of the elastic member 15 is received in that recessed portion 9*d*. This is devised to shorten the pitch between the head 9*b* and the first isolating plate 8*a*, to reduce the size of the connector 1, even when the length of the elastic member 15 is long to some extent. The elastic member 15 is constructed of a spring made of a metal (e.g. SUS, or the like). In this embodiment, the elastic member 15 comprises a portion of the connecting member 9.

In an upper surface of the first isolating plate 8*a* to be in contact with a lower portion of the elastic member 15 is formed a recessed portion 16 which covers (receives) a lower portion at one end of the elastic member 15. At the bottom of the recessed portion 16 (i.e. the base to be in contact with the lower portion of the elastic member 15) is provided a receiving member 17 made of a metal (e.g. SUS, or the like) which receives the elastic member 15 and which is for preventing damage to the first isolating plate 8*a* formed of an insulating resin.

The receiving member 17 prevents damage to the first isolating plate 8*a* by dispersing stress applied to the upper surface of the first isolating plate 8*a* from the elastic member 15. It is therefore preferred to make the contact area between the receiving member 17 and the first isolating plate 8*a* as large as possible. In this embodiment, to make the contact area between the receiving member 17 and the first isolating plate 8*a* large, the receiving member 17 shaped to contact the entire surface of the bottom of the recessed portion 16 is provided.

First Terminal Housing 5

The first terminal housing 5 is formed of a cylindrical hollow body 20 which is substantially rectangular in transverse cross section. An outer portion at one end (in FIG. 1A, at the right end) of the cylindrical body 20 mated with the second terminal housing 7 is formed in a tapered shape, taking into consideration the mateability with the second connector portion 3. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (in FIG. 1A, in the left end) of the cylindrical body 20 is accommodated a molded resin material 10 with the first connecting terminals 4*a* to 4*c* aligned and held therewith. In an outer portion at the other end of the cylindrical body 20 is formed a flange 24 for fixing the first connector portion 2 to a device chassis (e.g. a motor shield case). The flange 24 has an attachment hole 24*a* in its four corners, so that bolts not shown are inserted into the attachment holes 24*a* respectively and fixed to a chassis of a device or the like. At a rim 25 of the flange 24 may be provided a packing for sealing between the first connector portion 2 and the device chassis. Although in this embodiment the flange 24 is described as being provided to the first connector portion 2 to fix the first connector portion 2 to the device chassis, the flange 24 may be provided in the second connector portion 3, or in both the first connector portion 2 and the second connector portion 3. Also, the flange 24 may be omitted, and both of the first connector portion 2 and the second connector portion 3 may be free or not fixed to the device chassis.

Also, this flange 24 is effective in enhancing the dissipation of heat. That is, the formation of the flange 24 permits a large surface area of the first terminal housing 5, thereby allowing enhancement in the dissipation to outside via the first terminal housing 5, of heat produced inside the first connector portion 2 (e.g. heat produced at each contact).

For shielding performance, heat dissipation, and weight reduction of the lever connector 1, the cylindrical body 20 is formed of, preferably a high electrical conductivity, high thermal conductivity and lightweight metal such as an aluminum, but may be formed of a resin, or the like. In the case that the first terminal housing 5 is formed of an insulating resin, the second isolating plate 8*d* and the first terminal housing 5 may integrally be formed of the insulating resin. In this embodiment, the cylindrical body 20 is formed of aluminum.

In an upper portion (in FIG. 1A, in the upper side) of the cylindrical body 20 is formed a connecting member insertion hole 26 for inserting the connecting member 9. The first terminal housing 5 is formed in a cylindrical shape (hollow cylindrical shape) at a rim of the connecting member insertion hole 26. In a lower portion (in FIG. 1A, in the lower side) of that cylindrical portion of the first terminal housing 5 is formed an engaging groove 26*a* in such a notch shape as to penetrate that cylindrical portion of the first terminal housing 5. This engaging groove 26*a* is engaged onto a protrusion 9*c* of the connecting member 9, to serve to guide the protrusion 9*c* to guide the upward and downward movement of the connecting member 9.

Also, the first terminal housing 5 is formed integrally with the cylindrical body 20, and has a pressing member guiding portion 71 formed to cover an upper portion (in FIG. 1A, in the upper side) of the connecting member insertion hole 26. The pressing member guiding portion 71 is described later.

Referring to FIG. 5, when the first connector portion 2 is assembled, the connecting member 9, the elastic member 15, the first isolating plate 8*a*, and the molded resin material 10 to which the first connecting terminals 4*a* to 4*c* and the second isolating plates 8*b* to 8*d* have been attached beforehand, are, in turn, accommodated within the first terminal housing 5.

Figure 6A:
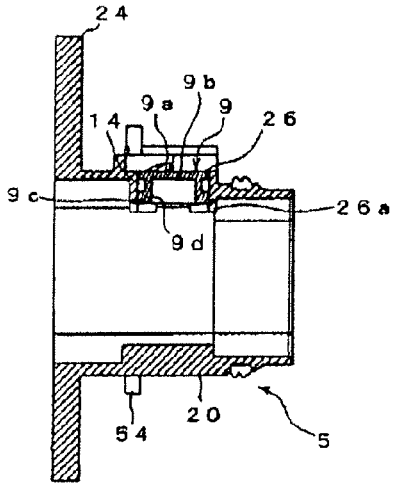
FIGS. 6A to 6D are diagrams for explaining a procedure for assembling the first connector portion of FIGS. 3A and 3B.
Figure 6B:
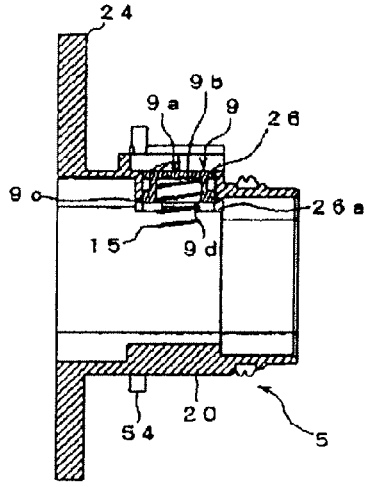
Figure 6C:
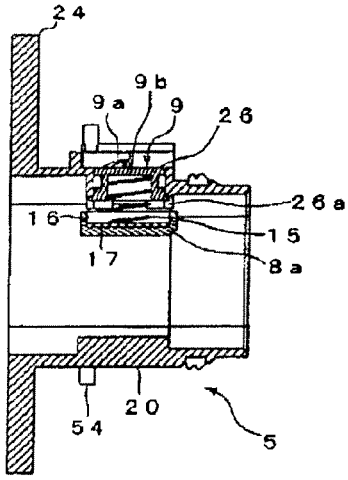
Figure 6D:
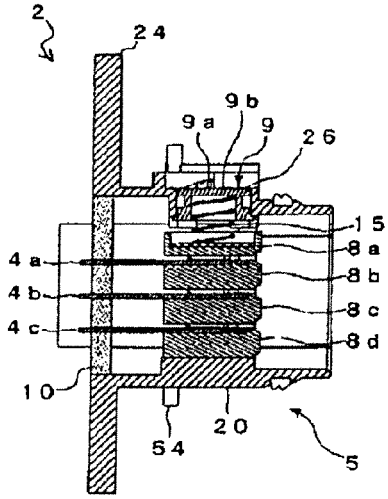

Referring to FIG. 6A, the connecting member 9 is first inserted from inside of the first terminal housing 5 into the connecting member insertion hole 26 in such a manner that the protrusion 9*c* of the connecting member 9 is engaged into the engaging groove 26*a*. Thereafter, referring to FIG. 6B, the elastic member 15 is received in the recessed portion 9*d* of the connecting member 9, and referring to FIG. 6C, the first isolating plate 8*a* is disposed to hold the elastic member 15 between it and the connecting member 9. Thereafter, referring to FIG. 6D, the molded resin material 10 with the first connecting terminals 4*a* to 4*c* and the second isolating plates 8*b* to 8*d* attached thereto is accommodated within the first terminal housing 5, and fixed to the first terminal housing 5, resulting in, the first connector portion 2.

When the first connector portion 2 and the second connector portion 3 are unmated, the connecting member 9 is biased up (outward in the first terminal housing 5) by the elastic member 15, but when the connecting member 9 is pressed down (inward in the first terminal housing 5) by a later-described pressing member 59, the head 9*b* of the connecting member 9 is pressed (in FIG. 6D, pressed down from above) against the adjacent first isolating plate 8*a* via the elastic member 15, to collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively. When the pressing by the pressing member 59 is released, the pressing of the adjacent first isolating plate 8*a* by the head 9*b* of the connecting member 9 is also released, so that the fixing at each contact is released.

Second Connector Portion 3

Next is described the second connector portion 3.

Referring to FIGS. 1A to 2B, 7A and 7B, the second connector portion 3 has the second terminal housing 7 with a plurality of (three) second connecting terminals (female terminals) 6*a* to 6*c* aligned and accommodated therein.

The second connecting terminals 6*a* to 6*c* are connected with cables 27*a* to 27*c*, respectively, at one end, which extend from an inverter. These cables 27*a* to 27*c* are electrically connected to the first connecting terminals 4*a* to 4*c* via the second connecting terminals 6*a* to 6*c*, respectively, and therefore supplied with electricity at voltages and/or currents in correspondence to the second connecting terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held to be aligned at a specified pitch by a multi-cylindrical cable holding member 30. With this cable holding member 30, when the first connector portion 2 and the second connector portion 3 are mated with each other, the second connecting terminals 6*a* to 6*c* are held to be positioned above the first connecting terminals 4*a* to 4*c* to face (i.e. to be connected to) the second connecting terminals 6*a* to 6*c* to form pairs respectively.

The cable holding member 30 is formed of an insulating resin, to isolate the second connecting terminals 6*a* to 6*c* from each other to prevent a short circuit. This cable holding member 30 allows the second connecting terminals 6*a* to 6*c* to be held at specified positions respectively, even when the cables 27*a* to 27*c* respectively connected to the second connecting terminals 6*a* to 6*c* have excellent flexibility. That is, in this embodiment, the cables 27*a* to 27*c* to be used can have excellent flexibility, and therefore enhance a degree of freedom of wiring the cables 27*a* to 27*c*.

Although the second connecting terminals 6*a* to 6*c* are positioned by the cable holding member 30 holding the cables 27*a* to 27*c*, more specifically, the ends near the second connecting terminals 6*a* to 6*c* of the cables 27*a* to 27*c* to hold the second connecting terminals 6*a* to 6*c* at specified positions respectively, the second connecting terminals 6*a* to 6*c* may be positioned by the cable holding member 30 holding the cables 27*a* to 27*c*, and the second connecting terminals 6*a* to 6*c* directly. Also, a connecting terminal holding member may, in place of the cable holding member 30, be used that holds not the cables 27*a* to 27*c*, but the second connecting terminals 6*a* to 6*c* directly.

In the case that, with the cable holding member 30, the second connecting terminals 6*a* to 6*c* are positioned by holding the cables 27*a* to 27*c* without directly holding the second connecting terminals 6*a* to 6*c*, that is, in the case of this embodiment, making the cables 27*a* to 27*c* flexible allows the tips of the second connecting terminals 6*a* to 6*c* to have flexibility relative to the second terminal housing 7. This construction permits flexible adaptation, even to deformation of first connecting terminal 4*a* to 4*c* portions (ports) to insert the second connecting terminals 6*a* to 6*c* in the first connector portion 2, when pressed by the connecting member 9.

Also, a braided shield not shown is wrapped around cables 27*a* to 27*c* portions drawn out of the second terminal housing 7, for the purpose of enhancement in shielding performance. This braided shield is contacted with a later-described cylindrical shield body 41, and electrically connected through the cylindrical shield body 41 to the first terminal housing 5 (an equipotential (GND)).

Second Connecting Terminals 6*a* to 6*c*

Referring to FIGS. 8A to 9B, the second connecting terminals 6*a* to 6*c* respectively include calking portions 32 for calking the conductors 28 exposed from the tips of the cables 27*a* to 27*c*, and plate contacts 33 formed integrally with the calking portions 32.

Figure 9A:
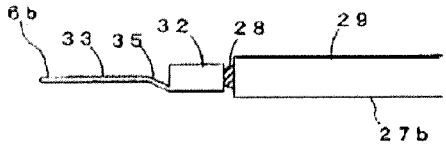
FIGS. 9A and 9B are a side view and a top view, respectively, showing second connecting terminals of the second connector portion of FIGS. 7A and 7B.
Figure 9B:
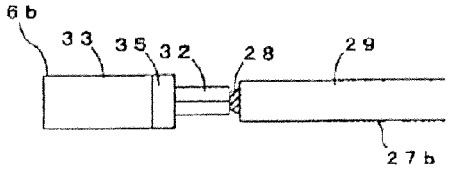

In this embodiment, to reduce the size of the lever connector 1, the cables 27*a* to 27*c* are configured to be aligned and held as close to each other as possible. To this end, as shown in FIGS. 9A and 9B, a trunk 35 of the second connecting terminal 6*b* to be connected to the cable 27*b* arranged in the middle when aligned is bent, to thereby space the second connecting terminals 6*a* to 6*c* apart at the same pitch.

The second connecting terminals 6*a* to 6*c* may each be constructed of a high electrical conductivity metal such as silver, copper, aluminum, or the like, in order to reduce the loss of power transmitted through the lever connector 1. Also, the second connecting terminals 6*a* to 6*c* each have slight flexibility.

Second Terminal Housing 7

Referring again to FIGS. 1A to 2B, 7A and 7B, the second terminal housing 7 is formed of a cylindrical hollow body 36 which is substantially rectangular in transverse cross section. To mate the first terminal housing 5 into the second terminal housing 7, an inner portion at one end (in FIG. 1A, at the left end) of the cylindrical body 36 mated with the first terminal housing 5 is formed in a tapered shape, taking into consideration the mateability with the first terminal housing 5.

In the other end (in FIG. 1A, in the right end) of the cylindrical body 36 is accommodated the cable holding member 30 with the cables 27*a* to 27*c* aligned and held therewith. On a cable insertion side of the cable holding member 30 is formed a packingless sealing portion, to prevent water from penetrating onto the cables 27*a* to 27*c* and into the female terminal housing 7. In an outer portion of the cable holding member 30 is provided a packing 38 to be in contact with an inner surface of the male terminal housing 5. That is, the lever connector 1 has a double waterproofing structure of the packing 23 of the terminal housing waterproofing structure 21 and the packing 38 provided in the outer portion of the cable holding member 30.

Further, the other end of the cylindrical body 36 from which the cables 27*a* to 27*c* are drawn out is covered with a rubber boot therearound not shown for preventing water from penetrating into the cylindrical body 36.

For shielding performance, heat dissipation, and weight reduction of the lever connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of an insulating resin. Therefore, to enhance its shielding performance and heat dissipation, the cylindrical shield body 41 made of an aluminum is provided on an inner surface at the other end of the cylindrical body 36.

The cylindrical shield body 41 has a contact 42 to be contacted with an outer portion of the first terminal housing 5 made of an aluminum when the first connector portion 2 and the second connector portion 3 are mated with each other. The cylindrical shield body 41 is thermally and electrically connected with the first terminal housing 5 via this contact 42. This enhances the shielding performance and the heat dissipation. In particular, the heat dissipation is likely to be significantly enhanced by positively allowing heat to escape toward the first terminal housing 5 having an excellent heat dissipation property.

Also, the cylindrical body 36 may be provided with a CPA (connector position assurance) lever not shown, which serves as a locking mechanism to fix a later-described turn lever 51 to a fixing position. In this case, the turn lever 51 is formed with a mating groove for mating onto that CPA lever, and after the turn lever 51 is turned into the fixing position, the CPA lever is pressed toward the turn lever 51 and mated into the mating groove, thereby locking the turn lever 51 to the fixing position.

Lever Structure 50 (Turn Lever 51, Housing Attaching/Detaching Mechanism 52, Connecting Member Manipulating Mechanism 53)

Next is described lever structure 50 according to the invention.

The lever connector 1 in this embodiment has a lever structure 50 including the turn lever 51 formed in a substantially U-shape, provided to hold both sides of the second terminal housing 7 of the second connector portion 3 at the cable 27*a* to 27*c* side, and turnably pivoted to the second terminal housing 7. Although the turn lever 51 may be provided to the first connector portion 2 at the device side, the turn lever 51, which, in this case, protrudes from the first terminal housing 5, may impede, strike against another member and be broken when the device is installed. It is therefore desirable that the turn lever 51 be provided to the second connector portion 3 at the cable 27*a* to 27*c* side.

The lever structure 50 includes a housing attaching/detaching mechanism 52 for turning the turn lever 51 to thereby pull and mate the first terminal housing 5 and the second terminal housing 7 together, or pull the first terminal housing 5 and the second terminal housing 7 apart to release the mating thereof, and a connecting member manipulating mechanism 53 for turning the turn lever 51 to thereby manipulate the connecting member 9, to apply a pressing force to each contact, or release the applying of that pressing force.

In this embodiment, the lever structure 50 is configured so that the turn lever 51 is turned in one turning direction from a releasing position into a mating position, thereby allowing the housing attaching/detaching mechanism 52 to pull and mate both the terminal housings 5 and 7 together, and so that the turn lever 51 is further turned in one turning direction from the mating position into a fixing position, thereby allowing the connecting member manipulating mechanism 53 to manipulate the connecting member 9, to apply a pressing force to each contact. This is because, if a pressing force is applied to each contact in circumstances of both the terminal housings 5 and 7 being not completely mated together, that pressing force causes difficulty mating both the terminal housings 5 and 7, and further makes friction large at the contacts between the first connecting terminals 4*a* to 4*c* and the second connecting terminals 6*a* to 6*c*, and the first connecting terminals 4*a* to 4*c* and the second connecting terminals 6*a* to 6*c* may therefore wear, so that the reliability may decrease.

Also, in this embodiment, both the connector portions 2 and 3 are connected by turning the turn lever 51 in the direction of separating from the first terminal housing 5, i.e. tilting the turn lever 51 down to the cable 27*a* to 27*c* side. Thus, in this embodiment, the releasing position of the turn lever 51 is the position of the turn lever 51 being tilted down to the first terminal housing 5 side (see FIGS. 1A and 1B), the fixing position of the turn lever 51 is the position of the turn lever 51 being tilted down to the cable 27*a* to 27*c* side (see FIGS. 2A and 2B), and the mating position of the turn lever 51 is located between the releasing position and the fixing position. Setting the fixing position at the position of the turn lever 51 being tilted down to the cable 27*a* to 27*c* side in this manner allows the second terminal housing 7 to be provided with the CPA for locking the turn lever 51 to the fixing position. This facilitates the installation of the CPA.

Housing Attaching/Detaching Mechanism 52 (Slide Shafts 54, Slide Grooves 55, First Cam Groove 56)

The housing attaching/detaching mechanism 52 is first described.

The housing attaching/detaching mechanism 52 includes slide shafts 54 comprising columnar protrusions formed to protrude from both sides respectively of the first terminal housing 5, slide grooves 55 formed in a straight line in a mating direction in both sides respectively of the second terminal housing 7, to guide the slide shafts 54, and a first cam groove 56 formed in the turn lever 51.

The first cam groove 56 comprises a circular arc groove eccentric in relation to a turn shaft 57 to which the turn lever 51 is pivoted. The first cam groove 56 is for mating both the terminal housings 5 and 7 together as follows: When the first cam groove 56 receives the slide shafts 54 inserted into the slide grooves 55 at the releasing position, and the turn lever 51 is then turned into the mating position, the first cam groove 56 fixes the slide shafts 54 between it and the slide grooves 55, and slides the slide shafts 54 to the cable 27*a* to 27*c* side, thereby pulling the first terminal housing 5 into the second terminal housing 7, resulting in the mated terminal housings 5 and 7.

In this embodiment, since the first cam groove 56 (and a later-described second cam groove 58) are formed to penetrate the turn lever 51, the slide shaft 54 insertion side end of the first cam groove 56 is formed with a reinforcing portion 51*a* which is stretched across the first cam groove 56. The reinforcing portion 51*a* is formed integrally with the turn lever 51, and formed in an arch shape to cause no interference with the slide shafts 54. The first cam groove 56 (and a later-described second cam groove 58) may be formed so as not to penetrate the turn lever 51, in which case the reinforcing portion 51*a* may be omitted.

Connecting Member Manipulating Mechanism 53 (First Locking Portion 9*a*, Second Cam Groove 58, Pressing Member 59, Pressing Member Guiding Portion 71)

The connecting member manipulating mechanism 53 is described next.

The connecting member manipulating mechanism 53 includes a first locking portion 9*a* comprising protrusions formed at the upper surface of the head 9*b* of the connecting member 9, a second cam groove 58 formed in the turn lever 51, a pressing member 59 provided within the second terminal housing 7 so that it turns integrally with the turn lever 51, and a pressing member guiding portion 71 which serves as a contact holding means for, when the pressing force is being applied to each contact, maintaining the pressing force applied to each contact, to maintain the electrical connections between the first connecting terminals 4*a* to 4*c* and the second connecting terminals 6*a* to 6*c*, respectively, even in the event of the turn lever 51 being broken, i.e., in the event of the absence of the turn lever 51.

Figure 3A:
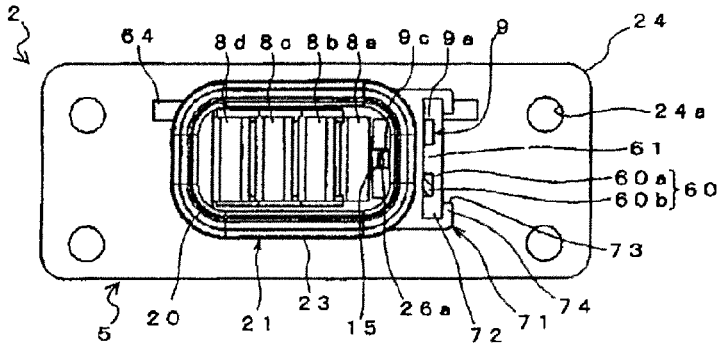
FIGS. 3A and 3B are a front view and a perspective view, respectively, showing a first connector portion of the lever connector of FIGS. 1A and 1B.
Figure 3B:
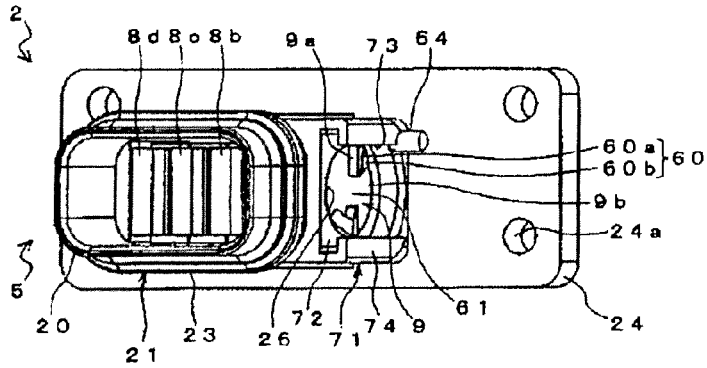

Referring to FIG. 3B, the first locking portion 9*a* comprises two protrusions 60 respectively formed at opposing positions in the upper surface of the substantially circular head 9*b* (point symmetric positions with respect to the center of the upper surface of the head 9*b*). Both the protrusions 60 include a substantially triangular prism shaped top 60*a*, and a sloping portion 60*b* gently connecting the top 60*a* and the upper surface of the head 9*b*.

The sloping portion 60*b* is for allowing a later-described second locking portion 63 to move easily onto the top 60*a* of the protrusions 60, when the turn lever 51 is turned from the mating position into the fixing position. The sloping portion 60*b* is formed in the direction of turning the second locking portion 63 (in the circumferential direction of the upper surface of the head 9*b*).

When the turn lever 51 is set into the fixing position, the second locking portion 63 moves onto and presses the top 60*a* of the protrusions 60. In other words, for the period of time the turn lever 51 is set in the fixing position (i.e. both the terminal housings 5 and 7 are mated together), the force constantly acts on the top 60*a* of the protrusions 60. In order to disperse this force to prevent creep deformation, the top 60*a* of the protrusions 60 is formed to have an appropriate area in its top view to be able to prevent creep deformation.

Between the two protrusions 60, i.e. in the middle portion of the upper surface of the head 9*b* is formed a spacing 61 through which the later-described second locking portion 63 of the pressing member 59 is passed, when both the terminal housings 5 and 7 are mated together.

Figure 7A:
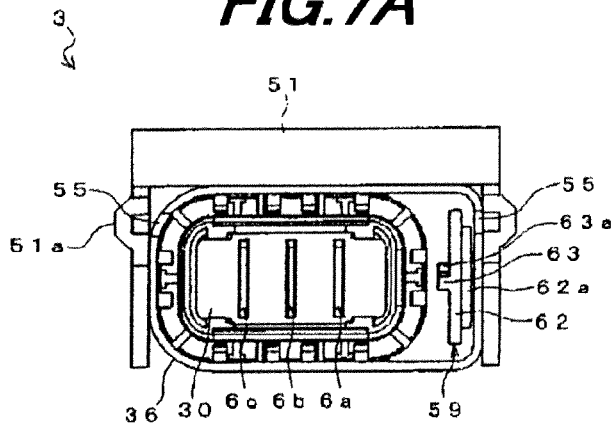
FIGS. 7A and 7B are a front view and a perspective view, respectively, showing a second connector portion of the lever connector of FIGS. 1A and 1B.
Figure 7B:
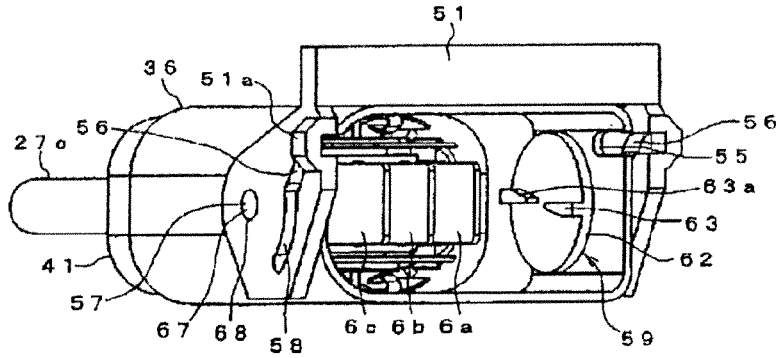
Figure 8A:
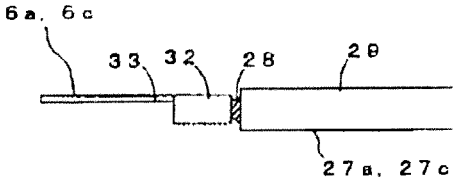
FIGS. 8A and 8B are a side view and a bottom view, respectively, showing second connecting terminals of the second connector portion of FIGS. 7A and 7B.
Figure 8B:
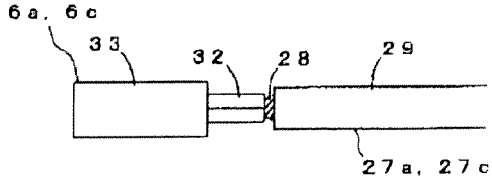

Referring to FIGS. 1B, 2B, and 7B, the second cam groove 58 comprises a circular arc groove concentric in relation to the turn shaft 57, and is formed continuously with the first cam groove 56. The second cam groove 58 formed allows the turn lever 51 to be turned from the mating position into the fixing position, while maintaining the mating of both the terminal housings 5 and 7 without sliding the slide shafts 54.

Referring to FIGS. 1A, 1B, 3A and 3B, the pressing member guiding portion 71, which serves as the contact holding means, is formed integrally with the cylindrical body 20 of the first terminal housing 5, to cover an upper portion (in FIG. 3A, the right side) of the connecting member insertion hole 26. This pressing member guiding portion 71 is for, when both the terminal housings 5 and 7 are mated together, guiding and receiving the pressing member, and for, when the turn lever 51 is turned to cause the pressing member 59 to press the head 9*b* of the connecting member 9, regulating and holding the pressing member 59 so that the pressing member 59 is not moved in the opposite direction to its pressing direction.

The pressing member guiding portion 71 is formed in a hollow box shape which is open at its second terminal housing 7 insertion side (in FIG. 3A, at the near side to the page), and its hollow portion 72 is formed to communicate with the connecting member insertion hole 26. This allows the first locking portion 9*a* of the connecting member 9 to be disposed to protrude into the hollow portion 72, when the head 9*b* of the connecting member 9 is inserted into the connecting member insertion hole 26 from inside of the first terminal housing 5.

An upper portion (in FIG. 3A, the right side) of the pressing member guiding portion 71 is formed with a guiding groove 73 for guiding the pressing member 59, so that the pressing member 59 is guided by the guiding groove 73 and inserted (received) into the hollow portion 72, when both the terminal housings 5 and 7 are mated together. Edges 74 of the pressing member guiding portion 71 on a periphery of the guiding groove 73 serve to regulate the pressing member 59 inserted into the hollow portion 72 so that the pressing member 59 is not moved in the opposite direction (in FIG. 3A, the right direction) to its pressing direction, when the connecting member 9 is pressed in by the pressing member 59.

Also, the flange 24 side (in FIG. 3B, the right far side) of the pressing member guiding portion 71 is formed in a semicircle shape in top view, along the pressing member 59 inserted into the hollow portion 72, when both the terminal housings 5 and 7 are mated together.

Referring to FIGS. 1A, 1B, 7A and 7B, the pressing member 59 includes a base 62 provided to turn integrally with the turn lever 51 within the second terminal housing 7, and a second locking portion 63 comprising a protrusion formed at the base 62.

The base 62 is formed of a disc member having a slightly larger diameter than the head 9*b*, and the second locking portion 63 is formed to protrude from one surface (in FIG. 7A, the left surface, which is herein simply referred to as the lower surface) of the base 62. The second locking portion 63 comprises two protrusions 63*a* respectively formed at opposing positions in the lower surface of the disc base 62 (point symmetric positions with respect to the center of the lower surface of the base 62). Both the protrusions 63*a* are formed in substantially the same triangular prism shape as the tops 60*a* of the protrusions 60 of the first locking portion 9*a*, and are located to face the tops 60*a*, respectively, when the turn lever 51 is set into the fixing position. The shape of the tops 60*a* of the protrusions 60, and the protrusions 63*a* is not limited to the triangular prism shape, but may be formed in a substantially rectangular parallelepiped shape, and the shapes of the tops 60*a* of the protrusions 60, and the protrusions 63*a* may also be different from each other.

The base 62 is formed in such a manner that the diameter of its opposite side (upper surface) to its lower surface decreases stepwise, and the decreased diameter portion 62*a* of the base 62 is inserted into and guided by the guiding groove 73 of the pressing member guiding portion 71.

Also, the upper surface of the base 62 is formed integrally with a shaft 64, which serves as the turn shaft 57 of the turn lever 51. The shaft 64 comprises a columnar base end 64*a*, which protrudes from a middle portion of the upper surface of the base 62, and an engaging portion 64*b* having an oval cross sectional shape (comprising two straight lines, and two curved lines each interconnecting ends of both those straight lines), which protrudes from a middle portion of the upper surface of the base end 64*a*.

The second terminal housing 7 is formed with a circular through hole 65 for pivoting the base end 64*a* of the shaft 64. Also, the turn lever 51 is formed with an oval engaging hole 66 for being engaged onto the engaging portion 64*b*. The base end 64*a* is passed into the through hole 65 from inside of the second terminal housing 7, and the engaging portion 64*b* is engaged into the engaging hole 66 of the turn lever 51, thereby allowing the pressing member 59 to be turnably attached to the second terminal housing 7, and turned integrally with the turn lever 51.

Although the engaging portion 64*b* and the engaging hole 66 are formed in an oval shape to turn the pressing member 59 integrally with the turn lever 51, the shape of the engaging portion 64*b* and the engaging hole 66 is not limited to the oval shape, but may be any shape, such as an ellipse, a polygon or the like, provided that the pressing member 59 integrally with the turn lever 51 are turnable integrally.

The other turn shaft 57 of the turn lever 51 comprises a columnar protrusion 67 formed on the opposite side surface of the second terminal housing 7 to the pressing member 59 side, so that its protrusion 67 is engaged into a circular engaging hole 68 formed in the turn lever 51. This allows the turn lever 51 to be attached to the second terminal housing 7 turnably about the shaft 64 provided integrally with the pressing member 59, and the protrusion 67, which both serve as the turn shaft 57 of the turn lever 51.

Connection of the First Connector Portion 2 and the Second Connector Portion 3

Next is described operation during connecting both the connector portions 2 and 3 in the lever connector 1, using FIGS. 10A to 12D.

Figure 10A:
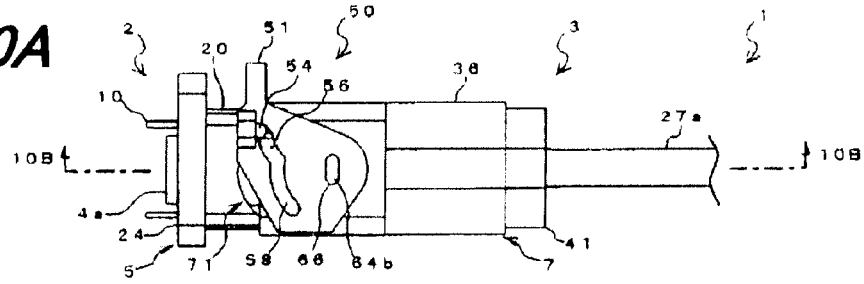
FIG. 10A is a side view showing the lever connector when setting the turn lever into a releasing position and receiving a slide shaft in a first cam groove.
Figure 10B:
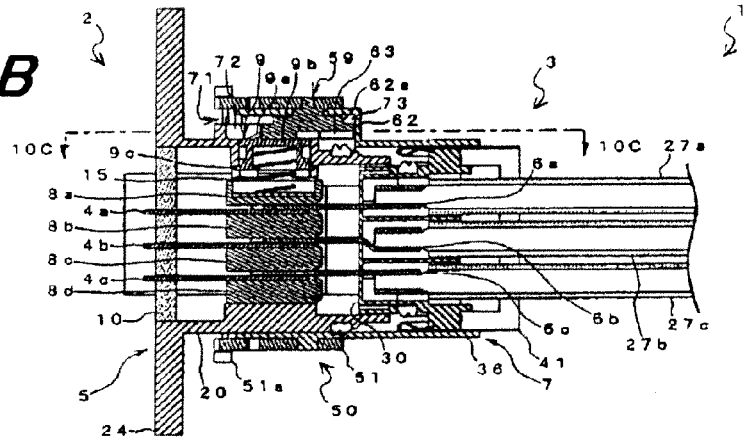
FIG. 10B is a cross-sectional view along line 10B-10B of FIG. 10A.
Figure 10C:
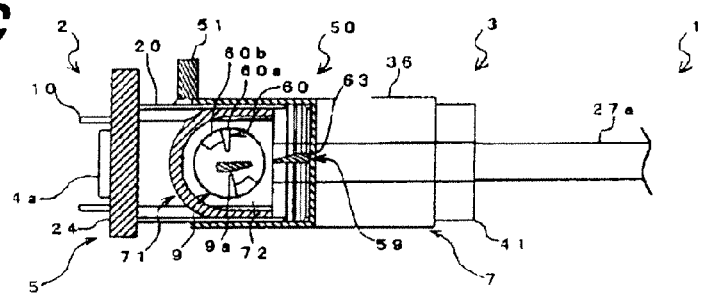
FIG. 10C is a cross-sectional view along line 10C-10C of FIG. 10B.

Referring to FIGS. 10A to 10C, to connect both the connector portions 2 and 3 together, the turn lever 51 is first set into the releasing position, so that the slide shafts 54 formed on both sides of the first terminal housing 5 are respectively inserted into the slide grooves 55 formed on both sides of the second terminal housing 7. The slide shafts 54 are slid along the slide grooves 55 respectively to the cable 27*a* to 27*c* side, and thereby received in the first cam groove 56 of the turn lever 51.

Figure 10D:
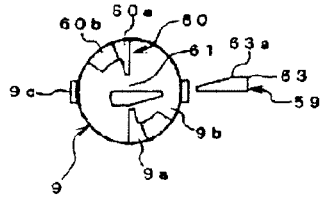
FIG. 10D is an explanatory diagram showing a positional relationship between a first locking portion and a second locking portion.

The pressing member 59 then operates in such a manner that a small diameter portion 62*a* of its base 62 is guided into the guiding groove 73 of the pressing member guiding portion 71, while a portion of that base 62 excluding that small diameter portion 62*a* and the second locking portion 63 are inserted into the hollow portion 72 of the pressing member guiding portion 71. Referring to FIG. 10D, the second locking portion 63 of the pressing member 59 is inserted through the spacing 61 between the two protrusions 60 of the first locking portion 9*a* into the hollow portion 72.

Figure 11A:
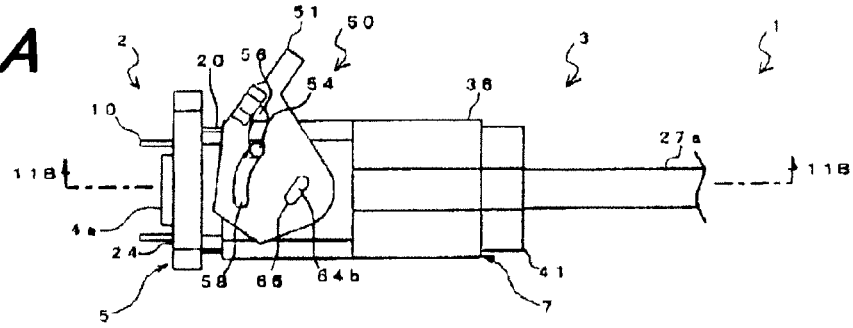
FIG. 11A is a side view showing the lever connector when setting the turn lever into a mating position.
Figure 11B:
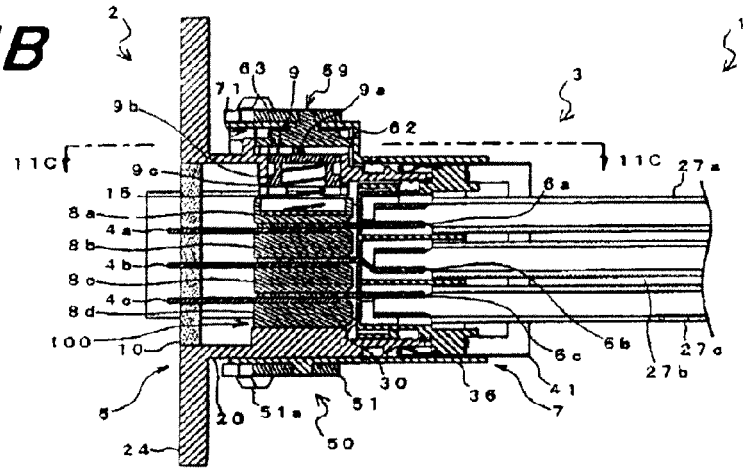
FIG. 11B is a cross-sectional view along line 11B-11B of FIG. 11A.
Figure 11C:
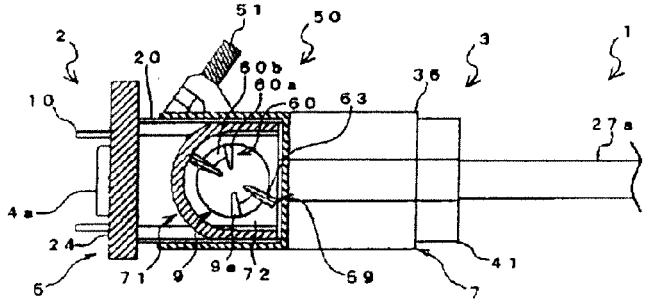
FIG. 11C is a cross-sectional view along line 11C-11C of FIG. 11B.

Referring to FIGS. 11A to 11C, the turn lever 51 is thereafter turned from the releasing position into the mating position. The slide shafts 54 are then fixed to between the slide grooves 55 and the first cam groove 56, and slid to the cable 27*a* to 27*c* side. This results in the first terminal housing 5 and the second terminal housing 7 being pulled together and completely mated together.

When both the terminal housings 5 and 7 are mated together, the second connecting terminals 6*a* to 6*c* are inserted between the first connecting terminal 4*a* with the isolating plate 8*b* and the isolating plate 8*a*, between the first connecting terminal 4*b* with the isolating plate 8*c* and the isolating plate 8*b*, and between the first connecting terminal 4*c* with the isolating plate 8*d* and the isolating plate 8*c*, respectively, where the first connecting terminals 4*a* to 4*c* and the second connecting terminals 6*a* to 6*c* form pairs respectively. That insertion then allows the plural first connecting terminals 4*a* to 4*c* and the plural second connecting terminals 6*a* to 6*c* to face each other to form pairs, respectively, and the first connecting terminals 4*a* to 4*c*, the second connecting terminals 6*a* to 6*c*, and the isolating plates 8*a* to 8*d* to be disposed alternately, i.e. the pairs of the first connecting terminals 4*a* to 4*c* and the second connecting terminals 6*a* to 6*c* to be alternately interleaved with the isolating plates 8*a* to 8*d*, to form a stacked structure. Thus, the stacked connection structure 100 can be completed.

At this point, inside the first connector portion 2, the second isolating plates 8*b* to 8*d* are respectively fixed to the tips of the first connecting terminals 4*a* to 4*c* held to be aligned at a specified pitch. A pitch between the second isolating plates 8*b*, 8*c* and 8*d* can therefore be held, even without separately providing a holding jig (see JP patent No. 4037199) for holding the pitch between the second isolating plates 8*b*, 8*c* and 8*d*. This allows the second connecting terminals 6*a* to 6*c* to be easily inserted between the first connecting terminal 4*a* with the isolating plate 8*b* and the isolating plate 8*a*, between the first connecting terminal 4*b* with the isolating plate 8*c* and the isolating plate 8*b*, and between the first connecting terminal 4*c* with the isolating plate 8*d* and the isolating plate 8*c*, respectively, where the first connecting terminals 4*a* to 4*c* and the second connecting terminals 6*a* to 6*c* form the pairs respectively. That is, the insertability/removability of the second connecting terminals 6*a* to 6*c* is not likely to deteriorate. Also, because of no need to provide a holding jig for holding the pitch between the isolating plates 8*b*, 8*c* and 8*d*, further size reduction can very effectively be achieved, compared to the prior art.

Also, the contact between the first connecting terminal 4*a* and the second connecting terminal 6*a* is sandwiched between the first isolating plate 8*a*, and the second isolating plate 8*b* fixed to the first connecting terminal 4*a* constituting that contact. Likewise, the contact between the first connecting terminal 4*b* (or 4*c*) and the second connecting terminal 6*b* (or 6*c*) is sandwiched between the second isolating plate 8*c* (or 8*d*) fixed to the first connecting terminal 4*b* (or 4*c*) constituting that contact, and the second isolating plate 8*b* (or 8*c*) fixed to the first connecting terminal 4*a* (or 4*b*) constituting the other contact.

Figure 11D:
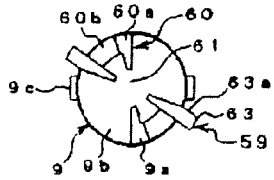
FIG. 11D is an explanatory diagram showing a positional relationship between the first locking portion and the second locking portion.

Also, when the turn lever 51 is turned from the releasing position into the mating position, the pressing member 59 is turned with the turning of the turn lever 51, and the second locking portion 63 is also turned therewith, but as shown in FIG. 11D, when the turn lever 51 is set into the mating position, the second locking portion 63 is located in a position of just before moving onto the first locking portion 9*a*, i.e. just before the sloping portion 60*b*. At this stage, the connecting member 9 is therefore not pressed by the pressing member 59.

Figure 12A:
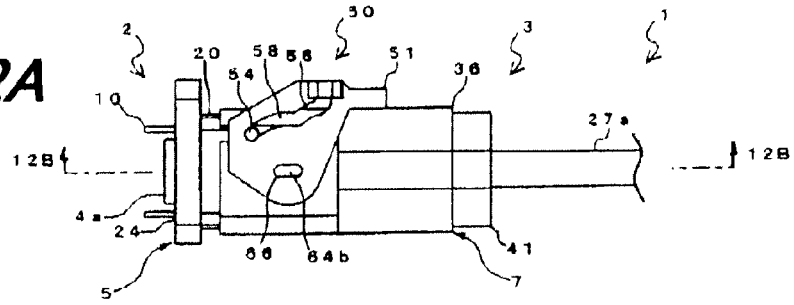
FIG. 12A is a side view showing the lever connector when setting the turn lever into a fixing position.
Figure 12B:
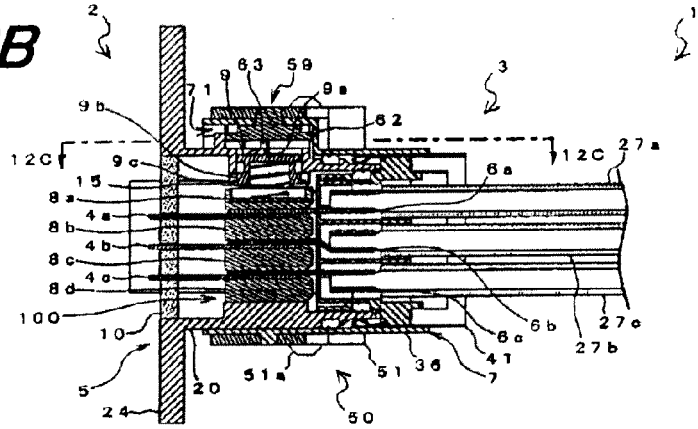
FIG. 12B is a cross-sectional view along line 12B-12B of FIG. 12A.
Figure 12C:
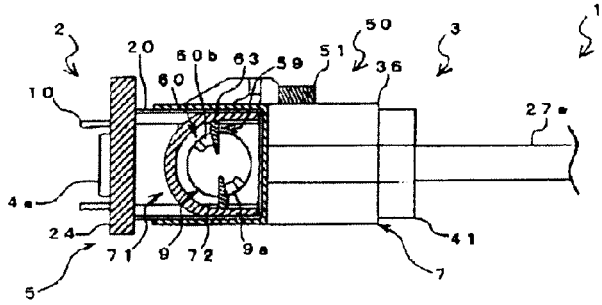
FIG. 12C is a cross-sectional view along line 12C-12C of FIG. 12B.
Figure 12D:
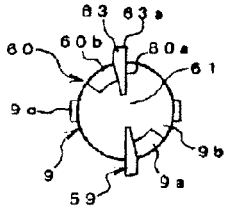
FIG. 12D is an explanatory diagram showing a positional relationship between the first locking portion and the second locking portion.

Referring to FIGS. 12A to 12C, the turn lever 51 is thereafter turned from the mating position into the fixing position. Although both the terminal housings 5 and 7 then remain mated together, the pressing member 59 is turned with the turning of the turn lever 51, and the second locking portion 63 moves onto the first locking portion 9*a*, thereby pressing the head 9*b* of the connecting member 9 downward (in FIG. 12B, downward). Referring to FIG. 12D, when the turn lever 51 is set into the fixing position, the two protrusions 63*a* of the second locking portion 63 face and press the tops 60*a* of the two protrusions 60 respectively of the first locking portion 9*a*, thereby pressing the head 9*b* of the connecting member 9 downward. Since the upward movement of the pressing member 59 relative to the base 62 is then regulated by the edges 74 of the pressing member guiding portion 71, the pressing member 59 is not moved upward, but only the head 9*b* of the connecting member 9 is pressed downward by the second locking portion 63 moving onto the first locking portion 9*a*.

The head 9*b* of the connecting member 9 pressed downward causes the elastic member 15 to, in turn, press the first isolating plate 8*a*, the second isolating plate 8*b*, the second isolating plate 8*c*, and the second isolating plate 8*d*, to press the contacts in such a manner as to sandwich the contacts between the isolating plates 8*a* and 8*b*, between the isolating plates 8*b* and 8*c*, and between the isolating plates 8*c* and 8*d*, respectively, with the contacts isolated from each other. In this case, by being pressed by the isolating plates 8*a* to 8*d*, the first connecting terminals 4*a* to 4*c* and the second connecting terminals 6*a* to 6*c* are slightly bent and contacted with each other, respectively, in a wide range. This allows each contact to be firmly contacted and fixed, even in a vibrational environment such as on vehicle. After the turn lever 51 is set into the fixing position, when the CPA is provided, the turn lever 51 is locked in the fixing position by the CPA.

As in FIGS. 12A to 12C, when the turn lever 51 is set into the fixing position, i.e. when the pressing force is being applied to each contact, if the turn lever 51 is broken, and even in the event of the absence of the turn lever 51, the pressing member 59 is received and held in the hollow portion 72 of the pressing member guiding portion 71. The pressing member 59 is therefore not likely to slip out due to the turn lever 51 being broken. Also, by the head 9*b* of the connecting member 9 being pressed down, the pressing member 59 is pressed against the edges 74 of the pressing member guiding portion 71. The pressing member 59 is therefore substantially not likely to move due to vibration, and lose its pressing force to the contacts. Thus, the lever connector 1 is possible to maintain the pressing force applied to each contact, to maintain the electrical connections between the first connecting terminals 4*a* to 4*c* and the second connecting terminals 6*a* to 6*c*, respectively, even in the event of the turn lever 51 being broken, i.e., in the event of the absence of the turn lever 51.

To release the connection of both the connector portions 2 and 3, the lock of the CPA is first released, and the turn lever 51 is turned from the fixing position into the mating position, thereby releasing the pressing of the head 9*b* of the connecting member 9 by the pressing member 59, releasing the pressing of the first isolating plate 8*a* by the connecting member 9, and releasing the fixing of each contact. Thereafter, the turn lever 51 is turned from the mating position into the releasing position, thereby pulling both the terminal housings 5 and 7 apart to release the mating thereof, and release the slide shafts 54 from the first cam groove 56. The slide shafts 54 are therefore slid along the slide grooves 55, and the first terminal housing 5 is thereby detached from the second terminal housing 7.

OPERATION AND ADVANTAGES OF THE EMBODIMENT

Operation and advantages of the embodiment are described.

The lever connector 1 in this embodiment has the lever structure 50 including the connecting member manipulating mechanism 53 for turning the turn lever 51 to thereby manipulate the connecting member 9, to apply a pressing force to each contact, or release the applying of that pressing force. That connecting member manipulating mechanism 53 includes the pressing member guiding portion 71 which serves as the contact holding means for, when the pressing force is being applied to each contact, maintaining the pressing force applied to each contact, to maintain the electrical connections between the first connecting terminals 4*a* to 4*c* and the second connecting terminals 6*a* to 6*c*, respectively, even in the event of the turn lever 51 being broken.

This allows the assurance of electrical conduction through the contacts, even if the turn lever 51 is broken. Thus, when the lever connector 1 is applied to a hybrid vehicle or electric vehicle, even if the turn lever 51 is broken, no interruption of electrical conduction through the contacts is likely to render that vehicle impossible to move.

Also, the lever connector 1 has the lever structure 50 further including the housing attaching/detaching mechanism 52 for turning the turn lever 51 to thereby pull and mate the first terminal housing 5 and the second terminal housing 7 together, or pull the first terminal housing 5 and the second terminal housing 7 apart to release the mating thereof.

This allows, in one turning of the turn lever 51, the mating (or unmating) of both the terminal housings 5 and 7, and subsequent applying of pressing force of the connecting member 9 to each contact (or releasing the applying of that pressing force). It is therefore possible to realize the lever connector 1 allowing the ease of attaching/detaching (connecting) the two connector portions 2 and 3 to/from (with) each other.

Also, with the lever connector 1, when the first connector portion 2 and the second connector portion 3 are connected together, the turn lever 51 is first turned, to allow the housing attaching/detaching mechanism 52 to pull and mate the first terminal housing 5 and the second terminal housing 7 together, and the turn lever 51 is thereafter turned further, to allow the connecting member manipulating mechanism 53 to manipulate the connecting member 9, to apply a pressing force to each contact.

This allows no pressing force to be applied to each contact by the connecting member 9 when both the terminal housings 5 and 7 are mated together, therefore making small (low) the inserting force during the mating of both the terminal housings 5 and 7, and facilitating the attaching/detaching of the two connector portions 2 and 3 more. Further, it allows no wear of the first connecting terminals 4*a* to 4*c* and the second connecting terminals 6*a* to 6*c* when both the terminal housings 5 and 7 are mated together, therefore enhancing reliability. Also, it allows the connecting member 9 to apply pressing force to each contact with both the terminal housings 5 and 7 being completely mated together, therefore preventing poor connections between the first connecting terminals 4*a* to 4*c* and the second connecting terminals 6*a* to 6*c* respectively.

Further, for the lever connector 1, the turn lever 51 is provided not for the first terminal housing 5 at the device side, but for the second terminal housing 7 at the cable 27*a* to 27*c* side.

In case that the turn lever 51 is provided to the first terminal housing 5 at the device side, the turn lever 51, which protrudes from the first terminal housing 5, may strike against another member and be broken when that device is installed. By providing the turn lever 51 for the second terminal housing 7, it is however possible to prevent the turn lever 51 from being broken when that device is installed.

Further, the lever connector 1 is configured so that both the connector portions 2 and 3 are connected by turning the turn lever 51 in the direction of separating from the first terminal housing 5, i.e. turning the turn lever 51 to the cable 27*a* to 27*c* side. This allows the second terminal housing 7 to be provided with the CPA for locking the turn lever 51 to the fixing position, therefore facilitating the installation of the CPA.

Also, since the lever connector 1 is formed with the sloping portion 60*b* for the first locking portion 9*a*, the second locking portion 63 is easily moved onto the first locking portion 9*a*.

Further, since the lever connector 1 is formed with the protrusion 9*c* for the head 9*b* of the connecting member 9, which serves as the rotation regulating portion of the connecting member 9, and that protrusion 9*c* is engaged into the engaging groove 26*a* formed in the first terminal housing 5 at a rim of the connecting member insertion hole 26, the connecting member 9 can be prevented from being rotated with the turning of the pressing member 59. Also, when both the terminal housings 5 and 7 are not mated, the connecting member 9 can be prevented from slipping out of the first terminal housing 5.

Further, for the lever connector 1, the pressing member 59 is inserted into the hollow portion 72 of the pressing member guiding portion 71, and the edges 74 of the pressing member guiding portion 71 regulate the pressing member 59 so that the pressing member 59 is not moved in the opposite direction to its pressing direction. It is therefore possible to maintain the pressing force applied to each contact, to assure electrical conduction through each contact, even in the event of the turn lever 51 being broken.

Also, since the lever connector 1 is formed with the recessed portion 16 in the upper surface of the first isolating plate 8*a* which covers (receives) the lower portion of the elastic member 15, and further with the recessed portion 9*d* in the lower surface of the head 9*b* of the connecting member 9 which receives the upper portion of the elastic member 15, the height of the elastic member 15 exposed between the head 9*b* and the first isolating plate 8*a* can be lowered by the amount received in the recessed portions 16 and 9*d*, and the slimming of the lever connector 1 can therefore be ensured, compared to the prior art. That is, the slimming of the lever connector 1 can be ensured, even when providing the elastic member 15 for exerting a pressing force.

Also, by the metallic receiving member 17 provided at the bottom of the recessed portion 16 receiving the pressing force of the elastic member 15, the elastic member 15 can be prevented from contacting the upper surface of the first isolating plate 8*a* at a small contact area and exerting an excessive force to the first isolating plate 8*a* formed of a resin, and the possibility of damaging the first isolating plate 8*a* can therefore be reduced. That is, the reliability and durability of the lever connector 1 can be enhanced.

The invention is not limited to the above embodiment, but various alterations may be made without departing from the spirit and scope of the invention.

For example, although in the above embodiment, three phase alternating power lines have been assumed, according to the technical idea of the invention, the connector for vehicles, for example, may be configured to collectively connect lines for different uses, such as three phase alternating current power lines for between a motor and an inverter, two phase direct current power lines for an air conditioner, and the like. This configuration allows power lines for a plurality of uses to be collectively connected by one connector. There is therefore no need to prepare a different connector for each use. This allows a contribution to space saving or low cost.

Also, the terminal surfaces of the first connecting terminals 4*a* to 4*c* and the second connecting terminals 6*a* to 6*c* may be knurled to make their frictional force large, so that the terminals are thereby unlikely to move relative to each other, and are firmly fixed at the contacts therebetween respectively.

Also, although in this embodiment it has been described that, unlike the second connecting terminals 6*a* to 6*c*, the first connecting terminals 4*a* to 4*c* are not connected with cables respectively, the first connecting terminals 4*a* to 4*c* are not limited to this structure.

Also, although in this embodiment, the cables 27*a* to 27*c* used have excellent flexibility, rigid cables may be used.

Also, in this embodiment, the use orientation of the connector is such that the connecting member 9 may be substantially horizontal or substantially vertical. In other words, the use conditions of the connector in this embodiment require no use orientation.

Also, although in this embodiment, the head 9*b* of the connecting member 9 is pressed against the adjacent first isolating plate 8*a* via the elastic member 15 constituting a portion of the connecting member 9, the head 9*b* may be pressed directly against the adjacent first isolating plate 8*a*, not via the elastic member 15.

Also, although in this embodiment, the connecting member 9, the elastic member 15 and the isolating plate 8*a* have been assembled separately, these connecting member 9, elastic member 15 and isolating plate 8*a* may be formed integrally beforehand, so that the integral connecting member 9, elastic member 15 and isolating plate 8*a* may be built into the first terminal housing 5. In this case, the isolating plate 8*a* can be a portion of the connecting member 9.

Also, although in this embodiment it has been described that the isolating plates 8*a* to 8*d* are provided only for the first connector portion 2, the isolating plates may be split, so that the isolating plates may be provided to both of the first connector portion 2 and the second connector portion 3.

Also, although in this embodiment it has been described that the sloping portion 60*b* is formed for the first locking portion 9*a*, the sloping portion 60*b* may, without being limited thereto, be formed for the second locking portion 63, or for both of the first locking portion 9*a* and the second locking portion 63.

Also, although in this embodiment it has been described that the connecting member 9 is provided only for one side of the first terminal housing 5, the connecting member 9 may be configured to be provided to both sides of the first terminal housing 5, so that both the connecting members 9 provided to both the sides respectively thereof apply pressing force to each contact. In this case, to correspond to both the connecting members 9, the pressing members 59 may be provided to both sides respectively of the second terminal housing 7, and the pressing member guiding portions 71 may be provided to both sides respectively of the first terminal housing 5.

Also, although in this embodiment the connecting member 9 has been constructed only of the head 9*b*, a penetrating connecting member formed with a shaft integral with the head 9*b*, which penetrates each contact, may be used.

Also, although in this embodiment the pressing member guiding portion 71 for guiding the pressing member 59 has been provided to cover the upper portion of the connecting member insertion hole 26, the pressing member guiding portion 71 may be omitted. In this case, the movement of the pressing member 59 in the opposite direction to its pressing direction is regulated directly by the second terminal housing 7.

What is claimed is:

1. A lever connector, comprising:

a first connector portion including a first terminal housing with a plurality of first connecting terminals aligned and accommodated therein;

a second connector portion including a second terminal housing with a plurality of second connecting terminals aligned and accommodated therein;

a plurality of isolating plates aligned and accommodated in the first terminal housing;

a stacked connection structure that, when the first terminal housing and the second terminal housing are mated together, the plural first connecting terminals and the plural second connecting terminals face each other to form pairs, respectively, and the isolating plates, the first connecting terminals and the second connecting terminals are disposed alternately;

a connecting member provided to the first connector portion, and including a head to press the adjacent isolating plate, to thereby fix the first connecting terminals and the second connecting terminals at the contacts therebetween, for electrical connections between the first connecting terminals and the second connecting terminals, respectively; and a lever structure including a turn lever provided to hold both sides of either one of the first terminal housing or the second terminal housing, and turnably pivoted to the first terminal housing or the second terminal housing, wherein the lever structure comprises a connecting member manipulating mechanism for turning the turn lever to thereby manipulate the connecting member, to apply a pressing force to each of the contacts, or release the applying of that pressing force, and wherein the connecting member manipulating mechanism includes a contact holder for, when the pressing force is being applied to each of the contacts, maintaining the pressing force applied to each of the contacts, to maintain the electrical connections between the first connecting terminals and the second connecting terminals, respectively, even in the event of the absence of the turn lever.

2. The lever connector according to claim 1, wherein the connecting member manipulating mechanism includes a first locking portion comprising protrusions formed at the head of the connecting member; and a pressing member including a base provided to turn integrally with the turn lever, and a second locking portion comprising a protrusion formed at the base, the pressing member for, when the turn lever is turned, allowing the second locking portion to move onto the first locking portion to press the head of the connecting member, to thereby apply the pressing force to each of the contacts, and the contact holder comprises a pressing member guiding portion provided in the first terminal housing, for, when both the terminal housings are mated together, guiding and receiving the pressing member, and for, when the turn lever is turned to cause the pressing member to press the head of the connecting member, regulating and holding the pressing member so that the pressing member is not moved in the opposite direction to its pressing direction.

3. The lever connector according to claim 2, wherein the first connector portion is attached to a device and the second connector portion is attached to a cable to electrically connect the device and the cable, and the turn lever is attached to the second terminal housing.

4. The lever connector according to claim 3, wherein the lever structure further includes a housing attaching/detaching mechanism for turning the turn lever to thereby pull and mate the first terminal housing and the second terminal housing together, or pull the first terminal housing and the second terminal housing apart to release the mating thereof, when the first connector portion and the second connector portion are connected together, the turn lever is first turned, to allow the housing attaching/detaching mechanism to pull and mate the first terminal housing and the second terminal housing together, and the turn lever is thereafter turned further, to allow the connecting member manipulating mechanism to manipulate the connecting member, to apply the pressing force to each of the contacts.

5. The lever connector according to claim 4, wherein the lever structure is configured so that the turn lever is turned in one turning direction from a releasing position into a mating position, to thereby allow the housing attaching/detaching mechanism to pull and mate both the terminal housings together, and so that the turn lever is turned further in one turning direction from the mating position into a fixing position, to thereby allow the connecting member manipulating mechanism to manipulate the connecting member, to apply the pressing force to each of the contacts, the housing attaching/detaching mechanism includes slide shafts comprising protrusions formed to protrude from both sides respectively of the first terminal housing, slide grooves formed in a mating direction in both sides respectively of the second terminal housing, to guide the slide shafts, and a first cam groove formed in the turn lever, and for, when the first cam groove receives the slide shafts inserted into the slide grooves at the releasing position, and the turn lever is then turned into the mating position, fixing the slide shafts between it and the slide grooves, pulling the first terminal housing into the second terminal housing, and mating both the terminal housings, and the connecting member manipulating mechanism further includes a second cam groove formed in the turn lever to be continuous with the first cam groove, and for turning the turn lever from the mating position to the fixing position with both the terminal housings being maintained to be mated together.

6. The lever connector according to claim 3, wherein the first locking portion and/or the second locking portion is formed with a sloping portion in a turning direction for, when the turn lever is turned, allowing the second locking portion to easily move onto the first locking portion, and the head of the connecting member is formed with a rotation regulating portion to regulate the rotation of the connecting member so that the connecting member is not rotated with the turning of the pressing member.

7. The lever connector according to claim 2, wherein both the connector portions are connected by turning the turn lever in the direction of separating from the first terminal housing.

8. The lever connector according to claim 1, further comprising an elastic member provided between the head of the connecting member and the adjacent isolating plate, to apply a specified pressing force to the adjacent isolating plate.

* * * * *